US007366437B2

(12) United States Patent
Inui et al.

(10) Patent No.: US 7,366,437 B2
(45) Date of Patent: Apr. 29, 2008

(54) IMAGE FORMING APPARATUS HAVING AN OPTICAL SENSOR PROVIDED IN OPPOSITION TO A TRANSFER BELT FORMED OF AN ENDLESS BELT

(75) Inventors: Hiroshi Inui, Osaka (JP); Chisato Hatakeyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 153 days.

(21) Appl. No.: 11/342,554

(22) Filed: Jan. 31, 2006

(65) Prior Publication Data

US 2006/0171727 A1 Aug. 3, 2006

(30) Foreign Application Priority Data

Feb. 2, 2005 (JP) ..... 2005-026801

(51) Int. Cl.
*G03G 15/00* (2006.01)
*G03G 21/00* (2006.01)

(52) U.S. Cl. ..... 399/98; 399/27; 399/107; 399/125

(58) Field of Classification Search ..... 399/107, 399/110, 27, 98, 99, 49, 118, 125, 262
See application file for complete search history.

(56) References Cited

U.S. PATENT DOCUMENTS 5,978,626 A * 11/1999 Nagamine et al. ..... 399/125
2003/0235428 A1* 12/2003 Suzuki et al. ..... 399/107
2004/0208670 A1* 10/2004 Abe ..... 399/110
2006/0002724 A1* 1/2006 Fujimori et al. ..... 399/27
2006/0056864 A1* 3/2006 Zaima ..... 399/27

FOREIGN PATENT DOCUMENTS

JP 2002031919 1/2002
JP 2003-255808 A * 9/2003
JP 2005-043468 A * 2/2005
JP 2005-164725 A * 6/2005

* cited by examiner

*Primary Examiner*—Sophia S. Chen
(74) *Attorney, Agent, or Firm*—Smith, Gambrell & Russell, LLP

(57) ABSTRACT

An image forming apparatus includes: a transfer belt that is formed of an endless belt; a plurality of image forming units that are so arranged as to be aligned in a transfer belt conveyance direction; a plurality of toner supply containers that are detachably fitted, on one end side in the direction orthogonal to the transfer belt conveyance direction, in correspondence with the plurality of image forming units; an optical sensor that is provided in opposition to the transfer belt; and a cleaning member that is biased toward the one end side in the direction orthogonal to the transfer belt conveyance direction and that cleans a detection surface of the optical sensor in conjunction with replacement operation for one particular toner supply container among the plurality of toner supply containers.

5 Claims, 6 Drawing Sheets

IMAGE FORMING APPARATUS HAVING AN OPTICAL SENSOR PROVIDED IN OPPOSITION TO A TRANSFER BELT FORMED OF AN ENDLESS BELT

This application is based on Japanese Patent Application No. 2005-26801 filed on Feb. 2, 2005, the contents of which are hereby incorporated by reference.

BACKGROUND OF THE INVENTION

1. Field of the Invention

The present invention relates to an image forming apparatus such as a digital color copier, a color laser printer, or the like.

2. Description of Related Art

As represented by conventional color copiers or the like, image forming apparatuses are conventionally known in which image forming units of different colors are arranged in tandem, with a transfer belt-serving as an intermediate transfer body.

The image forming apparatus of this type first forms (primary transfer) toner images of different colors on the transfer belt, and then collectively transfers (secondary transfer) the toner images formed on the transfer belt onto paper conveyed through a conveyance path different from a conveyance path of the transfer belt. To obtain favorable transfer quality in such a transfer belt method, it is required to previously make concentration correction or color adjustment of toner images formed on the transfer belt before transferred onto paper. Thus, in opposition to the upstream portion of the secondary transfer part of the transfer belt, an optical sensor for concentration correction or color adjustment is provided (see numeral 32 in FIG. 1).

However, since the optical sensor for concentration correction or color adjustment has a detection surface thereof arranged in opposition to the transfer belt, this detection surface tends to become stained by a toner dropping thereon. This adhering stain raises a risk that the detection accuracy deteriorates with time.

Thus, in conventional practice, in order to maintain favorably detection accuracy, the stain on the detection surface of the optical sensor is removed on a regular or irregular basis manually by the user who wipes it off or automatically by a cleaning member fitted to, for example, a solenoid driven by a motor.

Japanese Patent Application Laid-open No. 2002-31919 refers to an example of an optical sensor for detecting the color concentration of a toner image formed on a photo conductor, and also proposes that the detection surface of the optical sensor be cleaned by swinging a cleaning member in conjunction with open and close operation of a cover of a main body (see FIGS. 3 and 4 in the patent publication described above).

However, cleaning by the user cannot achieve sufficient cleaning performance, or may cause a secondary problem such as optical sensor breakage or the like.

A method using a motor, a solenoid, or the like requires a large-scale system, thus resulting in disadvantages in terms of cost, space, and the like.

The method of operating the cleaning member in conjunction with the open and close operation of the cover of the main body suffers from a problem such as open and close operation failure caused by cover floating. Moreover, if this cover is a conveyance cover for jam processing, the detection surface of the optical sensor is cleaned when paper jam occurs. Thus, the detection surface is never cleaned unless paper jam occurs, thus resulting in a greater risk of detection failure.

SUMMARY OF THE INVENTION

In view of the problems described above, the present invention has been made, and it is an object of the invention to provide an image forming apparatus equipped with a low-cost, space-saving cleaning mechanism for cleaning the detection surface of an optical sensor and capable of cleaning the detection surface in regular cycles without any failures.

To achieve the object described above, an image forming apparatus according to one aspect of the invention includes: a transfer belt that is formed of an endless belt; a plurality of image forming units that are so arranged as to be aligned in a transfer belt conveyance direction; a plurality of toner supply containers that are detachably fitted, on one end side in the direction orthogonal to the transfer belt conveyance direction, in correspondence with the plurality of image forming units; an optical sensor that is provided in opposition to the transfer belt; and a cleaning member that is biased toward the one end side in the direction orthogonal to the transfer belt conveyance direction and that cleans the detection surface of the optical sensor in conjunction with replacement operation for one particular toner supply container among the plurality of toner supply containers.

According to this configuration, moving the cleaning member in conjunction with replacement operation of a toner storage container, i.e., a consumable that is replaced after a fixed period, permits a low-cost, space-saving mechanism of cleaning the detection surface of the optical sensor, thereby permitting cleaning of the detection surface in regular cycles without causing any figures.

More specifically, the cleaning member includes a window that opposes the detection surface of the optical sensor and a cleaning cloth that is provided on a surface opposing the detection surface of the optical sensor and at a position adjacent to the window. The cleaning cloth rubbing the detection surface of the optical sensor in a reciprocating manner at replacement operation of the toner supply container to thereby wipe off a stain.

More specifically, the image forming apparatus further includes: a projection that is provided on one end surface of the cleaning member in the direction orthogonal to the belt conveyance direction; and a pressure spring that biases the cleaning member toward one end. According to this configuration, at the time of replacement of the toner supply container, by detaching the toner supply container from the image forming apparatus body, the cleaning member moves toward one end by the bias of the pressure spring, whereby the projection projects outward from the image forming apparatus body. Subsequently, by fitting the toner supply container to the image forming apparatus body, the leading end of the projection of the cleaning member is pressed by the rear surface of the toner supply container against the bias of the pressure spring, whereby the cleaning member moves toward the other end so that the detection surface of the optical sensor is located on the window of the cleaning member. In this manner, the cleaning member rubs the detection surface of the optical sensor in a reciprocating manner.

DETAILED DESCRIPTION OF PREFERRED EMBODIMENTS

Hereinafter, a description will be given on the embodiments of the present invention, with reference to the accompanying drawings.

Figure 1:
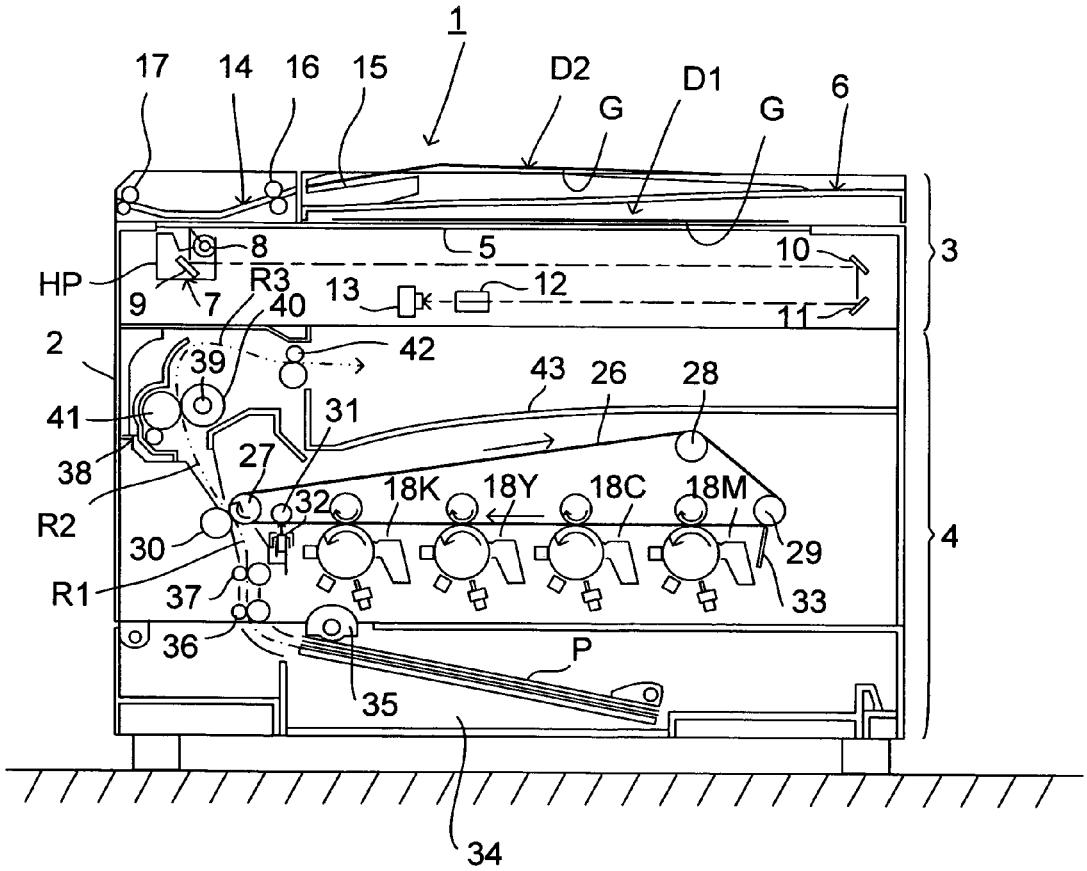
FIG. 1 is a schematic block diagram, in cross section, of a tandem-type color copier.

FIG. 1 is a schematic block diagram of a tandem-type full-color copier as one embodiment of an image forming apparatus according to the present invention. The image forming apparatus shown in this figure is a copier including a scanning part (image scanning unit) and a printing part (image forming unit). First, based on FIG. 1, a description will be given on the overall structure of the copier 1.

The copier 1 stores, in the upper portion of an apparatus body 2 thereof, the scanning part 3 for scanning the image surface (image information) G of a document D1 or D2, and has, in the lower portion of the apparatus body 2 thereof, the printing part 4 for forming a toner image onto paper P, such as a sheet or the like, in accordance with the image information scanned at the scanning part 3.

Of these parts, the former scanning part 3 includes: a document platen 5 on which the document D1 is loaded with the image surface G thereof facing downward; a document press plate 6 that is freely openable and closable and that brings the image surface G of the document D1 into close contact with the top surface of the document platen 5; a scanning unit 7 having a light source 8 for irradiating the image surface G of the document D1 loaded on the document platen 5 with light and a first reflecting mirror 9; a second and a third reflecting mirrors 10 and 11 for further reflecting the light from the first reflecting mirror 9; a lens array 12 for focusing the light from the third reflecting mirror 11; and a CCD 13 on which the light from the lens array 12 is made incident. The scanning unit 7 scans the image surface G of the document D1 with the light source 8 while moving from its home position HP shown in FIG. 1 to the right, and returns to the home position HP after completion of scanning. The construction described above is a construction for performing so-called stationary document scan by which the image surface G is scanned by moving the scanning unit 7 while the document D1 is kept fixed.

In addition to those described above, the scanning part 3 includes an automatic document feed mechanism 14 for so-called moving document scan by which the image surface G is scanned by moving the document D2 while the scanning unit 7 is kept fixed. The automatic document feed mechanism 14 includes a paper feed table 15 for supporting the leading end side of the document D2 from the bottom; a paper feed roller pair 16 for conveying the document D2 loaded on the paper feed table 15 leftward to the scanning unit 7 arranged at the home position HP; and a paper discharge roller pair 17 for carrying the document D2 scanned by the scanning unit 7 leftward from the scanning unit 7. The automatic document feed mechanism 14 conveys the document D2 leftward as viewed in FIG. 1 by the paper feed roller pair 16 and the paper discharge roller pair 17, and then after scanning of the document D2 is completed, pinches the trail end of the document D2 by the paper discharge roller pair 17 and discharges it by the paper discharge roller pair 17 to the left side surface of the apparatus body 2 in such a manner as to hang downward. In this condition, the document D2 can be easily pulled out of the paper discharge roller pair 17 by a human.

Discriminative use of the stationary document scan and moving document scan is made in, for example, a manner such that the document D1, such as a bound printed book or the like, is loaded on the document platen 5 and is subjected to stationary document scan while the document D2, such as a cart sheet or the like, is loaded on the document platen 5 and subjected to moving document scan.

In the printing part 4, provided in parallel below a transfer belt 26 (in a tandem manner) in order from the right as viewed in FIG. 1 are primary transfer units (image forming units) 18M, 18C, 18Y, 18K for forming respective images of different colors, namely, magenta, cyan, yellow, and black. The primary transfer units 18M to 18K include: as indicated by an enlarged view of a transfer part of FIG. 2, amorphous silicon photoconductive drums (image carriers) 19M to 19K; main chargers 20M to 20K provided therearound; LED exposure parts 21M to 21K; developing units 22M to 22K; primary transfer rollers 23M to 23K; and cleaners 24M to 24K. On one end side of the primary transfer units 18M to 18K in the direction orthogonal to the transfer belt conveyance direction (frontward from the paper surface in FIGS. 1 and 2), toner supply containers 25M to 25K (see FIG. 5) for supplying toners of different colors to the respective developing units 22M to 22K are removably fitted to the apparatus body 2.

The transfer belt 26 is wound around a drive roller 27, a tension roller 28, and a driven roller 29. The transfer belt 26 is driven by the drive roller 27 into circular rotation. At a position opposing the drive roller 27, a secondary transfer roller 30 is detachably arranged so as to be in pressure contact with the transfer belt 26. A toner image formed on the transfer belt 26 is transferred onto paper passing through a pressure contact area between the secondary transfer roller 30 and the transfer belt 26.

Upstream of the drive roller 27 in the transfer belt conveyance direction (on the right hand side on the paper surface in FIGS. 1 and 2), a backup roller 31 is so arranged as to be in pressure contact, from the inside, with the transfer belt 26. At a position opposing the backup roller 31, a detector 32 for concentration correction or color adjustment is disposed near but not in contact with the transfer belt 26 to detect the concentration or the color of a toner image formed on the transfer belt 26 so that, based on this, the developing bias, transfer bias, or the like is adjusted. At a position opposing the driven roller 29, a cleaning blade 33 is so provided as to be in contact with the transfer belt 26 in a separable manner. By this cleaning blade 33, the toner image transferred onto the transfer belt 26 for the aforementioned concentration correction or color adjustment is removed from the transfer belt 26.

Figure 2:
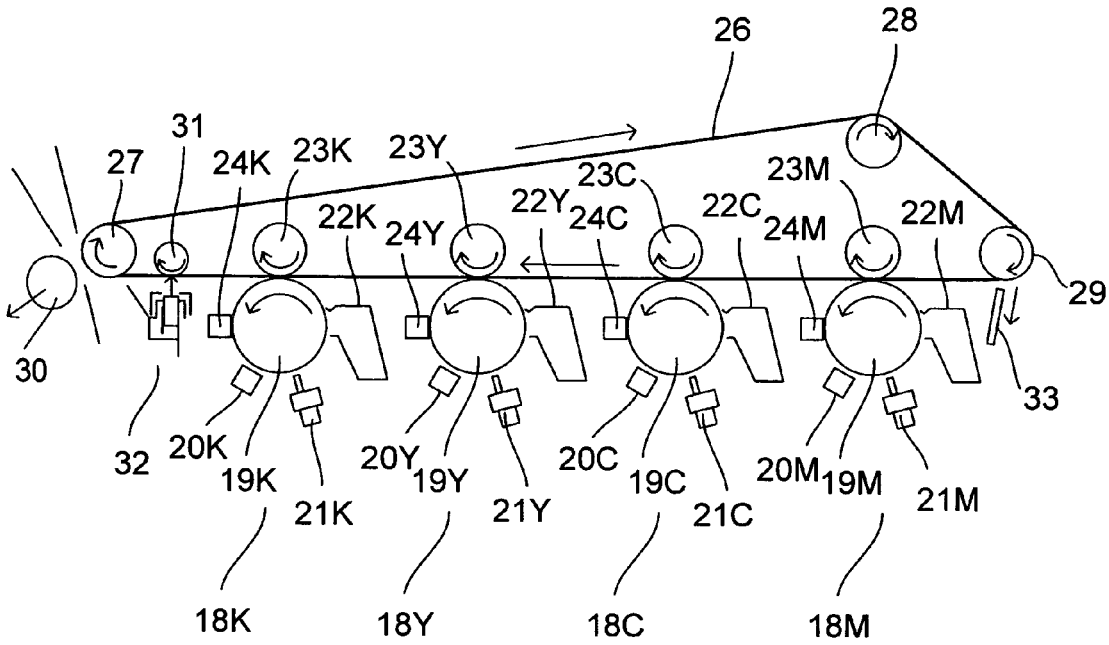
FIG. 2 is a schematic block diagram of a transfer part, showing the state in which a toner image is primarily transferred onto a transfer belt.

Thereafter, as shown in FIG. 2, the transfer belt 26 makes one rotation with the secondary transfer roller 30 and the cleaning blade 33 being separated from the transfer belt 26. Meanwhile, to the transfer belt 26 sequentially passing between the photoconductive drums 19M to 19K in the respective primary transfer units 18M to 18K and the primary transfer rollers 23M to 23K, a voltage of a polarity opposite to that of toners is applied to the transfer rollers 23M to 23K, whereby toner images formed on the photoconductive drums 19M to 19K are (primarily) transferred onto the transfer belt 26. At the passage through the primary transfer units 18M to 18K, the toner images of the respective colors are sequentially primarily transferred onto the transfer belt 26, so that a final toner image is formed on the transfer belt 26.

The paper P onto which the toner image has been transferred and which has been stored in a paper feed cassette 34 is fed by a paper feed roller 35, conveyed through a conveyance path R1 by a conveyance roller pair 36, paused by a registration roller pair 37, and thereafter delivered from the registration roller pair 37 in synchronization with the toner image formed on the transfer belt 26.

Figure 3:
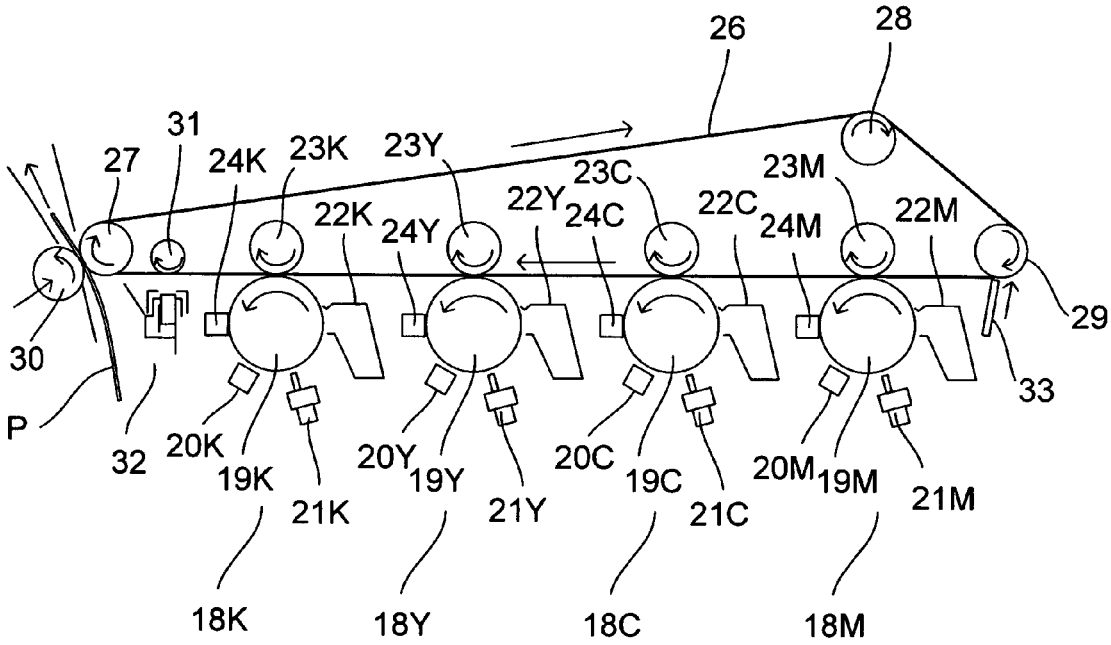
FIG. 3 is a schematic block diagram of the transfer part, showing the state in which a toner image formed on the transfer belt is secondarily transferred onto paper.

Then, as shown in FIG. 3, the secondary transfer roller 30 and the cleaning blade 33 are made in pressure contact with the surface of the transfer belt 26, whereby the toner image formed on the transfer belt 26 is (secondarily) transferred onto the paper P. After the transfer of the toner image, the toners remaining on the photoconductive drums 19M to 19K are removed by the cleaners 24M to 24K, respectively. After the transfer of the toner image, the toner remaining on the transfer belt 26 is removed by the cleaning blade 33 so as to be provided for subsequent image formation.

Then, as shown in FIG. 1, the paper P is carried through a conveyance path R2 to a fixing roller 38, where the toner is fixed onto the paper P through heat and pressure application. The fixing roller 38 has a fixing roller 40 that is heated by a heater 39 disposed thereinside and a pressure roller 41 that presses the paper P against the fixing roller 40. The fixing roller 38 applies heat and pressure to conveyed paper carrying a non-fixed toner image on the surface thereof to thereby fix this toner image. The paper P passing through the fixing roller 38 is discharged through a conveyance path R3 onto a paper discharge tray 43 by a paper feed roller pair 42.

Next, a description will be given on the detector for concentration correction or color adjustment.

Figure 4:
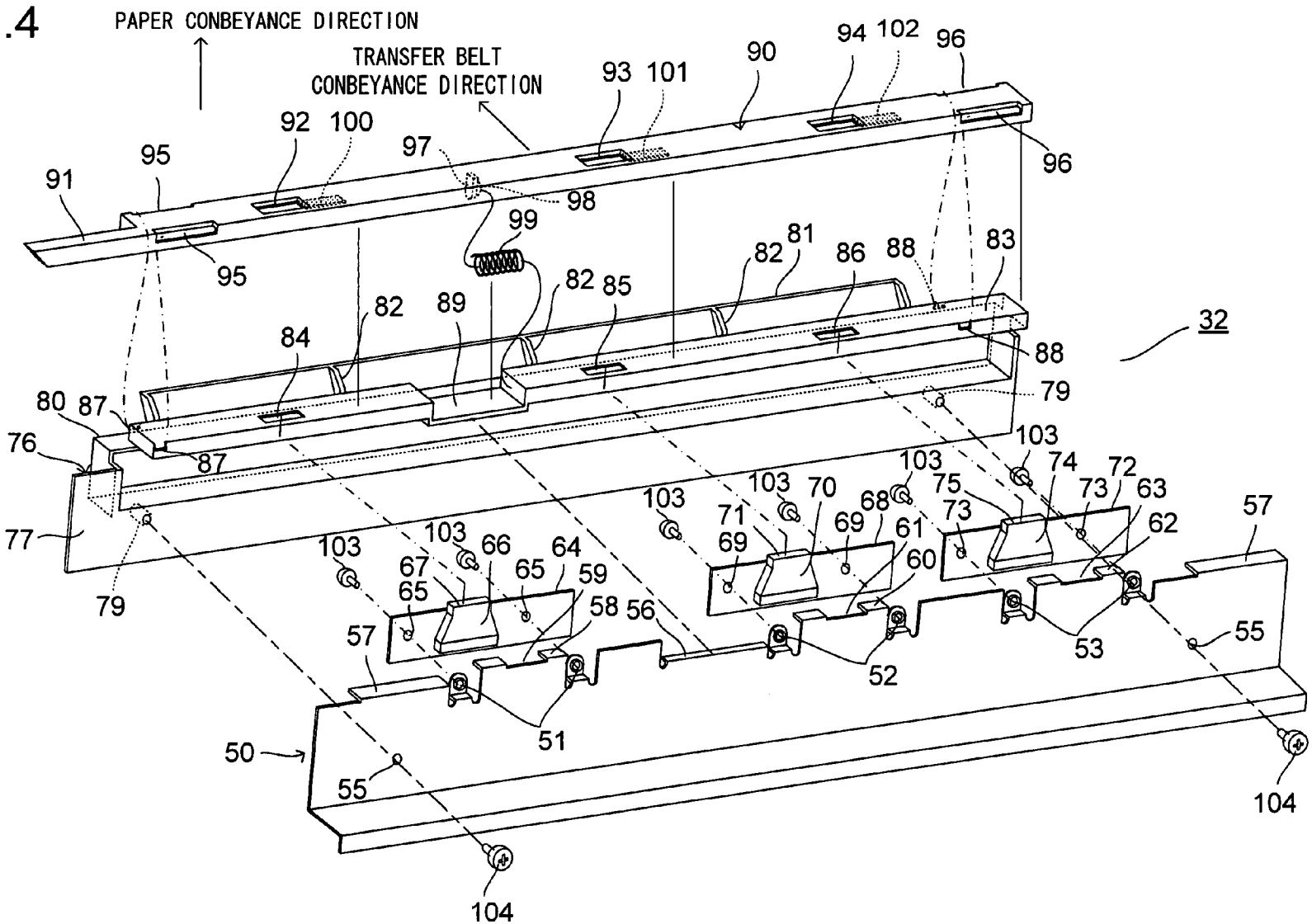
FIG. 4 is an exploded perspective view of a detector for concentration correction or color adjustment that includes a cleaning member according to one embodiment of the invention.

FIG. 4 is an exploded perspective view of a detector 32. The detector 32 for concentration correction or color adjustment is roughly composed of three members: a plate 50, a cover member 76, and a cleaning member 90. Each of the three members will be described in detail below.

At the upper portions of the plate 50, pairs of bosses 51, 52, and 53 are formed at predetermined intervals by being cut and bent.

Between the bosses 51 and 51, a bending piece 58 is formed which is bent in an L shape toward the downstream in the transfer belt conveyance direction. Similarly, between the bosses 52 and 52 and between the bosses 53 and 53, bending pieces 60 and 62 are respectively formed. The bending pieces 58, 60, and 62 are so formed as to be substantially flush with one another. Between the bosses 51 and 52, a bending piece 56 having a predetermined length is formed at a position lower than these bending pieces 58, 60, and 62. At one end and the other end of the plate 50, at a position lower than the bending pieces 58, 60, and 62 but higher than the bending piece 56, a pair of bending pieces 57 is so formed as to be flush with each other.

At the central portion of the bending piece 58, a notch 59 is formed in a rectangular shape. Similarly, bending pieces 60 and 62 are also respectively formed with notches 61 and 63.

An optical sensor 66 for concentration correction or color adjustment is mounted on a substrate 64 in a manner such that a tapered upper square column thereof protrudes upward from the upper edge of the substrate 64. Similarly, an optical sensor 70 for concentration correction or color adjustment is mounted on a substrate 68 in a manner such that a tapered upper square column thereof protrudes upward from the upper edge of the substrate 68. Similarly, an optical sensor 74 for concentration correction or color adjustment is mounted on a substrate 72 in a manner such that a tapered upper square column thereof protrudes upward from the upper edge of the substrate 72. Hereinafter, "an optical sensor for concentration correction or color adjustment" is simply referred to as "optical sensor".

To the pair of bosses 51, the substrate 64 is fitted with screws 103 penetrating through a pair of circular holes 65 provided in the substrate 64. In this condition, the upper square column portion of the optical sensor 66 is located in the notch 59 of the bending piece 58 so that a detection surface 67 formed on the top surface of the optical sensor 66 projects vertically upward from the bending piece 58. Similarly, to the pair of bosses 52, the substrate 68 is fitted with screws 103 penetrating through a pair of circular holes 69 provided in the substrate 68. In this condition, the upper square column portion of the optical sensor 70 is located in the notch 61 of the bending piece 60 so that a detection surface 71 formed on the top surface of the optical sensor 70 projects vertically upward from the bending piece 60. Similarly, to the pair of bosses 53, the substrate 72 is fitted with screws 103 penetrating through a pair of circular holes 73 provided in the substrate 72. In this condition, the upper square column portion of the optical sensor 74 is located in the notch 63 of the bending piece 62 so that a detection surface 75 formed on the top surface of the optical sensor 74 projects vertically upward from the bending piece 62.

Through the plate 50 near the both ends thereof in the direction orthogonal to the transfer belt conveyance direction, a pair of circular openings 55 penetrates.

The cover member 76 is fitted downstream of the plate 50 in the transfer belt conveyance direction, and serves for protecting the substrates and the optical sensors and for guiding paper transfer and also guiding the cleaning member 90 to be described below.

The cover member 76 is roughly composed of a fitting part 77 formed in a plate-like shape, a sensor cover part 80 integrally formed, in a box-like shape, with the fitting part 77 on the downstream side thereof in the transfer belt conveyance direction, a paper guide part 81 integrally formed, in a plate-like shape, with the sensor cover part 80 on the downstream side thereof in the transfer belt conveyance direction, and a cleaning guide part 83 integrally formed on the top surface of the sensor cover part 80.

On the surface of the fitting part 77 downstream in the transfer belt conveyance direction and near the both ends thereof in the direction orthogonal to the transfer belt conveyance direction, a pair of bosses 79 are formed in correspondence with the respective circular holes 55 of the plate 50.

The sensor cover part 80 has a surface upstream in the transfer belt conveyance direction that is flush with the surface of the fitting part 77, and thus is formed in an open box-like shape.

The paper guide part 81 is formed in a plate-like shape so as to be increasingly tilted, from the downstream-side outer surface of the sensor cover part 80 upward (more downstream in the paper conveyance direction), to the downstream in the transfer belt conveyance direction, and is reinforced by a plurality of ribs 82 formed in parallel in the direction orthogonal to the transfer belt conveyance direction.

The cleaning guide part 83 is formed in an open box-like shape with a bottom surface thereof flush with the top surface of the sensor cover part 80. In the upper wall of the cleaning guide part 83, three windows 84, 85, and 86 are respectively formed in correspondence with the detection surfaces 67, 71, and 75 of the respective optical sensors in such a manner as to be aligned in the direction orthogonal to the transfer belt conveyance direction. Near one upper end and the other upper end of both side walls of the cleaning guide part 83 opposing each other in the transfer belt conveyance direction, pairs of pawls 87 and 88 are respectively formed. Formed partially on the cleaning guide part 83 over a predetermined range between the windows 84 and 85 is a depression 89 that is so depressed as to be lower than the top surface of the sensor cover part 80.

To the pair of bosses 79, the plate 50 is fitted with screws 104 through the pair of circular holes 55 provided in the plate 50. In this condition, the bending pieces 58, 60, and 62 of the plate 50 are located on the inner surface of the upper wall of the cleaning guide part 83 of the cover member 76, and the bottom surfaces of both end walls of the cleaning guide part 83 of the cover member 76 are placed on the bending piece 57 of the plate 50. The upper square columns of the optical sensors 66, 70, and 74 are inserted through the respective windows 84, 85, and 86 of the cleaning guide part 83, so that portions 67, 71, and 75 formed on the top surface thereof are so oriented as to be vertically upward and substantially flush with the top surface of the cleaning guide part 83 (see FIG. 6).

The cleaning member 90 is formed in a box shape with the bottom surface and the other end surface thereof (end surface on the right hand side of the paper surface as viewed in FIG. 4) opened. On the upper wall of the cleaning member 90, three windows 92, 93, and 94 are formed in correspondence with the detection surfaces 67, 71, and 75 of the respective optical sensors in such a manner as to be aligned in the direction orthogonal to the transfer belt conveyance direction. Near one upper end and the other upper end of the both side walls of the cleaning member 90 opposing each other in the transfer belt conveyance direction, pairs of guide holes 95 and 96 each having a predetermined length are formed in correspondence with the pairs of pawls 87 and 88, respectively.

The cleaning member 90 has an inner hollow portion thereof adapted to have a dimension substantially equal to that of the exterior of the cleaning guide part 83 of the cover member 76 so that the cleaning member 90 can slide along the cleaning guide part 83. On one end surface of the cleaning member 90, a lance-like projection 91 is so formed as to project over a predetermined length in the direction orthogonal to the transfer belt conveyance direction.

From the inner surface of the upper wall between the windows 92 and 93 of the cleaning member 90, a projecting piece 97 projects which is to be located on the depression 89 of the cover member 76, with the surface thereof on the window 93 side fitted with a spring fitting part 98 formed in a columnar shape.

On the inner surface of the upper wall of the cleaning member 90, cleaning clothes 100, 101, and 102 formed in a rectangular shape are respectively attached adjacently to the other end side of the windows 92, 93, and 94 of the cleaning member 90 (on the right hand side of the paper surface as viewed in FIG. 4).

The cleaning member 90 is slidably fitted by fitting the pair of pawls 87 and 88 of the cover member 76 into the pair of guide holes 95 and 96, respectively. The movable range of the cleaning member 90 is determined by the length of the guide holes 95 (or 96) and the width of the pawls 87 (or 88).

In this condition, to the spring fitting part 98, one end of a pressure spring 99 is fitted so that the projecting piece 97 is located on the depression 89 of the cover member 76, and the other end of the pressure spring 99 is pressed against the other end wall of the depression 89, whereby the cleaning member 90 is biased toward one end.

Next, the cleaning mechanism and operation of the detection surface of the optical sensor will be described, with reference to FIGS. 5 to FIG. 7.

Figure 5:
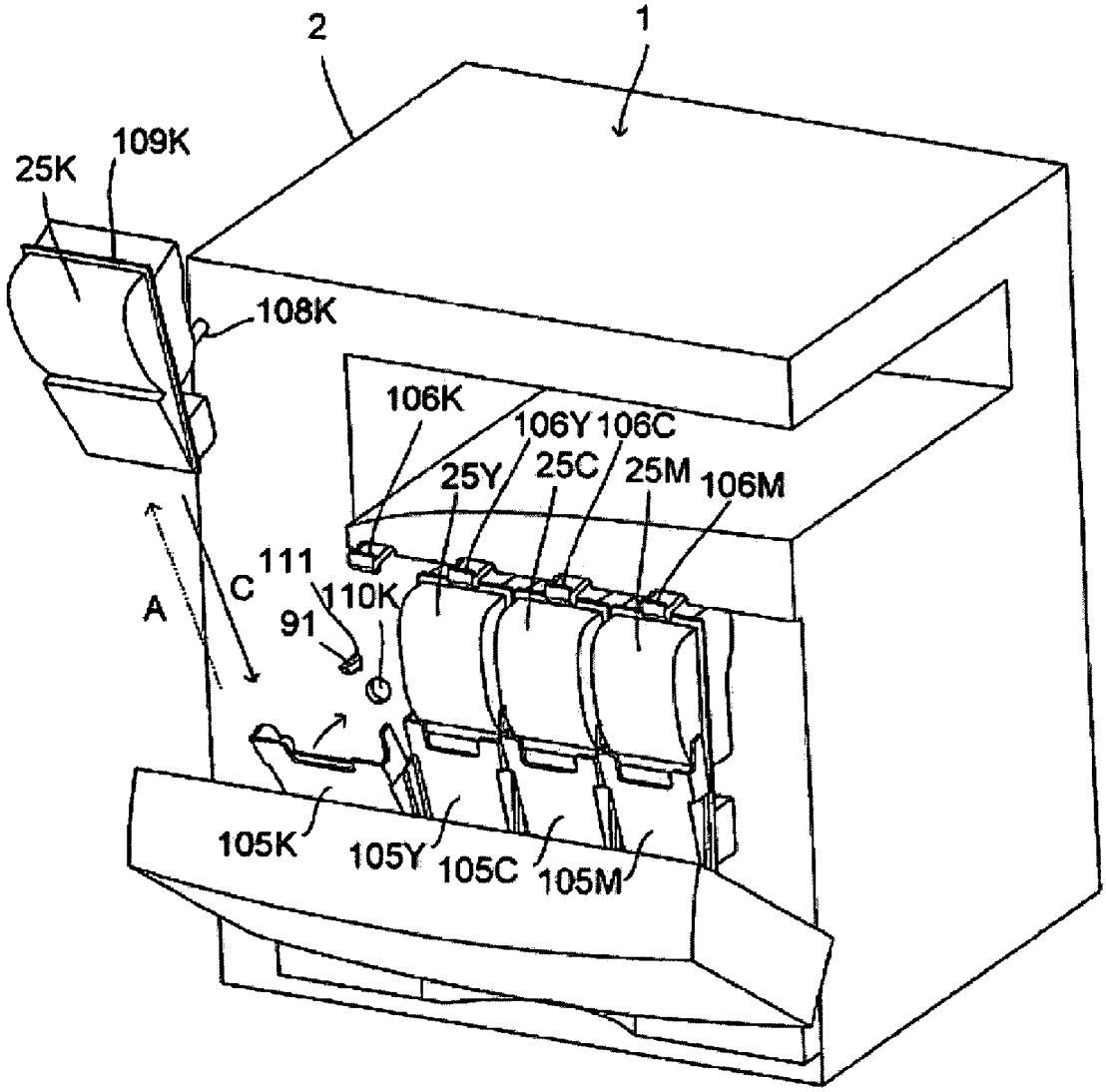
FIG. 5 is a schematic external perspective view of the copier.

As shown in FIG. 5, on the front wall of the apparatus body 2, there are provided: insert holes (only the insert hole 110K is shown in the figure) for inserting therein toner supply ports of the toner supply container 25M to 25K (only the toner supply port 108K of the toner supply container 25K is shown in the figure) in the apparatus body 2; rotatable pockets 105M to 105K for inserting therein the respective toner supply container 25M to 25K; and locking pawls 106M to 106K for locking edge frames formed around the respective toner supply containers 25M to 25K (only the edge frame of the toner supply container 25K is represented by numeral 109K).

At the time of replacement of a toner supply container, the locking pawl is lifted up to release the locking condition, the pocket is tilted to the front to pull out the used toner supply container, and then a new toner supply container is installed by inserting it in the pocket and then locking the frame thereof with the locking pawl in such a manner as to lift up the pocket. Near the insert hole 110K formed in the front wall of the apparatus body 2, a through hole 111 is provided which permits the projection 91 of the cleaning member 90 to be inserted therethrough.

Figure 6:
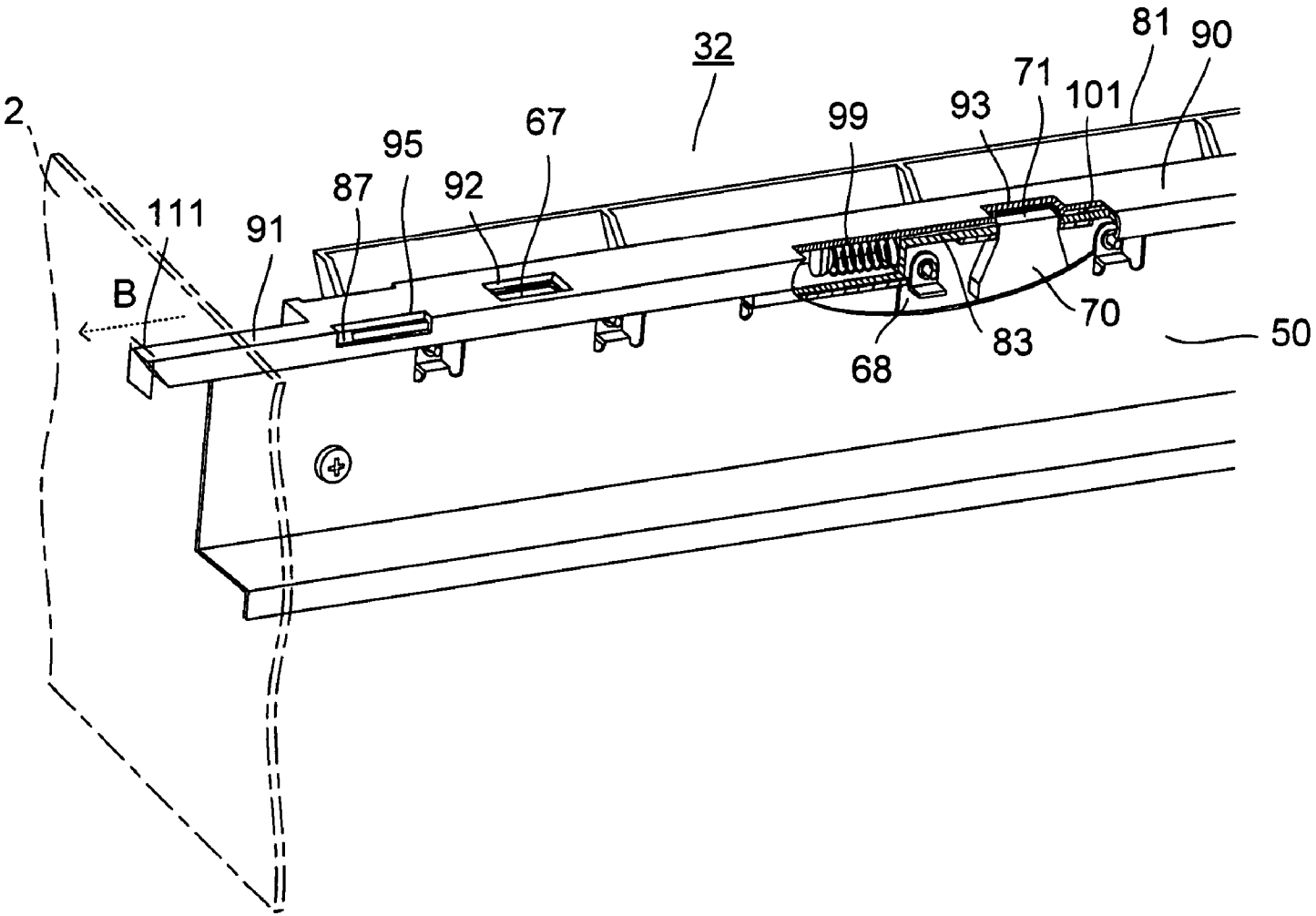
FIG. 6 is a partial perspective view of a detector and an apparatus body, partially broken for description of the positional relationship between windows of the cleaning member and the detection surfaces of optical sensors in a normal usage condition of the image forming apparatus.

In a normal usage condition of the copier 1, as shown in FIG. 6, the leading end of the projection 91 of the cleaning member 90 is pressed by the rear surface of the toner supply container 25K, not shown, against the bias of the pressure spring 99, so that the detection surfaces 67, 71, and 75 of the respective optical sensors are respectively located in the windows 92, 93, and 94 of the cleaning member 90 in such a manner as to be oriented substantially vertically upward, thereby permitting concentration correction or color adjustment of a toner image formed on the transfer belt 26.

When a toner is completely consumed and thus replacement of the toner supply container is required, as shown by arrow A of FIG. 5, the used toner supply container 25K is first removed from the apparatus body 2. As a result, the toner supply container 25K is no longer pressed by the leading end of the projection 91 of the cleaning member 90. Thus, as shown by arrow B of FIG. 6, the cleaning member 90 slides toward the one end by the bias of the pressure spring 99, the projection 91 projects through the through hole 111 to the outside of the apparatus body 2, during which the detection surfaces 67, 71, and 75 of the respective optical sensors are respectively rubbed by the cleaning cloths 100, 101, and 102 attached on the inner surface of the upper wall of the cleaning member 90.

Figure 7:
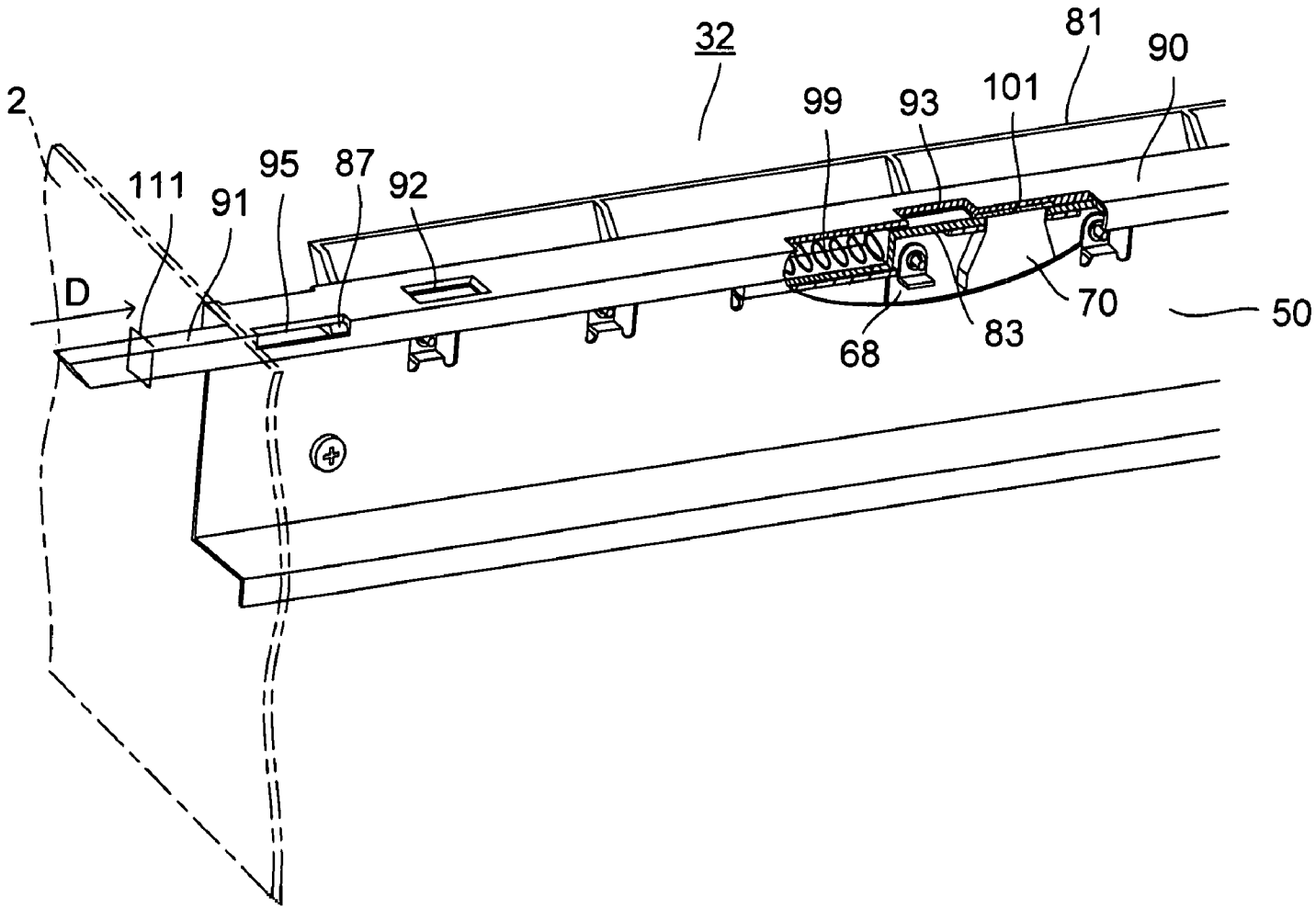
FIG. 7 is a partial perspective view of the detector and the apparatus body, partially broken for description of the positional relationship between cleaning cloths of the cleaning member and the detection surfaces of the optical sensors at the time of replacement of a toner supply container.

As shown by arrow C of FIG. 5, when a new toner supply container 25K is fitted to the apparatus body 2, the leading end of the projection 91 of the cleaning member 90 is pressed by the rear surface of the toner supply container 25K against the bias of the pressure spring 99, and then, as shown by arrow D of FIG. 7, the cleaning member 90 slides toward the other end, whereby the detection surfaces 67, 71, and 75 of the respective optical sensors are respectively located in the windows 92, 93, and 94 of the cleaning member 90 in such a manner as to be oriented substantially vertically upward, during which the detection surfaces 67, 71, and 75 of the respective optical sensors are again respectively rubbed by the cleaning cloths 100, 101, and 102 attached on the inner surface of the upper wall of the cleaning member 90.

In this way, reciprocatingly rubbing the detection surface 67, 71, and 75 of the respective optical sensors with the cleaning cloths 100, 101, and 102, respectively, at the time of the replacement of the toner supply container 25K wipes off dirt on the detection surfaces 67, 71, and 75, thereby permitting regular cleaning.

Moreover, in addition to elimination of a labor of wiping off the detection surfaces on the user side, drive components such as a solenoid, a motor, and the like are not used, thereby permitting a low-cost, space-saving mechanism of cleaning the detection surfaces of the optical sensors. Further, the cleaning members not only move in conjunction with the cover of the apparatus body but also slide in conjunction with replacement operation for a consumable, i.e., a toner storage container, which is replaced after a fixed period. This permits cleaning of the detection surfaces of the optical sensors in regular cycles.

The present invention is not limited to the embodiments described above. For example, the cleaning member is adapted to slide in conjunction with replacement operation for the black toner supply container; however, the cleaning member may also be adapted to slide at replacement operation of a particular toner supply container other than the black toner supply container. The number of optical sensors and the interval therebetween are not limited to those described above; therefore, in accordance with thee number and the interval, the number and position of windows and cleaning cloths to be provided in the cleaning member can obviously be appropriately set. As one example of an optical sensor, the optical sensor for concentration correction or color adjustment has been described above. However, the optical sensor is not limited to this, and thus an optical sensor may be used which is provided in opposition to the transfer belt and which detects the toner image or the state of the belt surface. As one example of an image forming apparatus, the image forming apparatus that employs a secondary transfer method has been described. However, the image forming apparatus is not limited to this and thus an image forming apparatus may be applied which employs a direct transfer method in which a toner image is directly transferred onto paper placed on a transfer belt.

What is claimed is:

1. An image forming apparatus comprising:

a transfer belt that is formed of an endless belt;

a plurality of image forming units that are so arranged as to be aligned in a transfer belt conveyance direction;

a plurality of toner supply containers that are detachably fitted, on one end side in a direction orthogonal to the transfer belt conveyance direction, in correspondence with the plurality of image forming units;

an optical sensor that is provided in opposition to the transfer belt;

a cleaning member that is biased toward the one end side in the direction orthogonal to the transfer belt conveyance direction and that cleans a detection surface of the optical sensor in conjunction with replacement operation for one particular toner supply container among the plurality of toner supply containers;

a window that is provided at the cleaning member and that faces the detection surface of the optical sensor; and a cleaning cloth that is provided on a surfaced opposing the detection surface of the optical sensor at a position adjacent to the window, wherein the cleaning cloth rubs the detection surface of the optical sensor at replacement operation of the toner supply container.

2. The image forming apparatus according to claim 1, wherein the cleaning member rubs the detection surface of the optical sensor in a reciprocating manner.

3. The image forming apparatus according to claim 2, further comprising:

a projection that is provided on one end surface of the cleaning member in the direction orthogonal to the transfer belt conveyance direction; and a pressure spring that biases the cleaning member toward one end.

4. The image forming apparatus according to claim 3, wherein the detection surface of the optical sensor is located in the window of the cleaning member while the toner supply container is fitted to an image forming apparatus body.

5. The image forming apparatus according to claim 4, wherein, by fitting the toner supply container to the image forming apparatus body, a leading end of the projection of the cleaning member is pressed by a rear surface of the toner supply container against bias of the pressure spring.

* * * * *